US005647447A

United States Patent [19]

Jones

[11] Patent Number: 5,647,447

[45] Date of Patent: Jul. 15, 1997

[54] BIT RETENTION DEVICE FOR A BIT AND CHUCK ASSEMBLY OF A DOWN-THE-HOLE PERCUSSIVE DRILL

[75] Inventor: William Leslie Jones, Moneta, Va.

[73] Assignee: Ingersoll-Rand Company, Woodcliff Lake, N.J.

[21] Appl. No.: 662,725

[22] Filed: Jun. 10, 1996

[51] Int. Cl.[6] ..... E21B 4/06; E21B 4/14

[52] U.S. Cl. ..... 175/300; 175/414; 173/132

[58] Field of Search ..... 175/173, 189, 175/414, 395, 300; 173/133, 132

[56] References Cited

U.S. PATENT DOCUMENTS

| | | | |
|---|---|---|---|
| 3,322,216 | 5/1967 | Kurt | 173/132 |
| 3,735,820 | 5/1973 | Curington | 173/133 X |
| 4,079,793 | 3/1978 | Mosely et al. | 173/132 X |
| 4,083,415 | 4/1978 | Kita et al. | 173/132 |
| 4,805,705 | 2/1989 | Liljebrand et al. | 173/132 X |
| 4,961,469 | 10/1990 | Larsson et al. | 173/132 X |
| 5,390,749 | 2/1995 | Lyon | 175/296 |
| 5,435,401 | 7/1995 | Hedlund et al. | 175/296 |

*Primary Examiner*—Frank Tsay
*Attorney, Agent, or Firm*—John J. Selko

[57] ABSTRACT

A bit retention device for a bit and chuck assembly of a down-the-hole, percussive drill, for retaining a head section of a bit should the head section separate from a shank of the bit includes a chuck adapted for threadable connection to a drill casing, a drill bit, a bit retaining shoulder in the the assembly; a wear collar concentric about the chuck and bit and a flexible retaining member removably connected to the assembly, the retaining member extending radially between the wear collar and bit a sufficient distance to contact the retaining shoulder should the bit drop axially downwardly.

6 Claims, 3 Drawing Sheets

BIT RETENTION DEVICE FOR A BIT AND CHUCK ASSEMBLY OF A DOWN-THE-HOLE PERCUSSIVE DRILL

BACKGROUND OF THE INVENTION

This invention relates generally to down-the-hole, percussive drills, and more particularly to retention devices for retaining a head section of a bit should the head section separate from a shank of the bit.

In percussion downhole drilling, broken bits are a common occurrence because of the severe impact and rotational loads necessary to accomplish the drilling effect. Failures in the shank result in the head portion of the bit remaining in the hole. Time consuming and expensive procedures are required to remove the head before drilling can continue. If the head cannot be removed, the hole must be abandoned.

It is common practice to provide external "fishing" threads on the rear portion of the bit head to facilitate removal of the broken bit head by use of an internally threaded "fishing" tool. This is a somewhat difficult separate operation and results are very often futile.

Therefore it would be very advantageous to provide a system where the broken portion of the bit is automatically retrieved with the drill string and hammer.

One device for this purpose as described in U.S. Pat. No. 5,065,827 (Meyers, et. al.). This device includes an attachment piece with internal threads and a corresponding external thread on the bit. Such devices have several disadvantages. The threaded engagement may be lost if reverse rotation occurs after bit failure, resulting in bit head loss. Meyers suggests that a pin may be installed to prevent this, but this complicates removal even more. Also, if the threads are damaged in normal drilling, the removal of an unbroken bit for sharpening or other service is difficult or impossible without destroying the device.

The foregoing illustrates limitations known to exist in present drill bit retention devices. Thus, it is apparent that it would be advantageous to provide an alternative directed to overcoming one or more of the limitations set forth above.

Accordingly, a suitable alternative is provided including features more fully disclosed hereinafter.

SUMMARY OF THE INVENTION

In one aspect of the present invention, this is accomplished by providing a bit retention device for a bit and chuck assembly of a down-the-hole, percussive drill, for retaining a head section of a bit should the head section separate from a shank of the bit includes a cylindrical chuck adapted for threadable connection to a drill casing, the chuck terminating in a radially extending lower end face surface; bit retaining shoulder means in the assembly for forming a radially extending bit retaining shoulder; a drill bit including: an axially extending shank in driving engagement with the chuck, the shank terminating in a radially extending driving shoulder, the driving shoulder having an upper surface facing the end face surface of the chuck; a bit head having a working bit face; and an upper bit head portion adjacent to the retaining shoulder, the upper bit head portion extending axially along the bit head, the upper bit head portion having a radial diameter that is smaller than a radial diameter of the retaining shoulder; a wear collar of hollow cylindrical form concentric about a lower portion of the chuck and the upper bit head portion; a flexible retaining member removably connected to the assembly, the retaining member positioned within the wear collar, the retaining member positioned axially between the chuck end face surface and the bit working face, the retaining member extending radially between the wear collar and the upper bit head portion a sufficient distance to contact the retaining shoulder should the bit drop axially downwardly, whereby the drill bit is movable axially within the chuck, but retained within the chuck by the retaining shoulder and the retaining member; and aperture means in the wear collar for permitting access to the retaining member by an adjustment tool.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
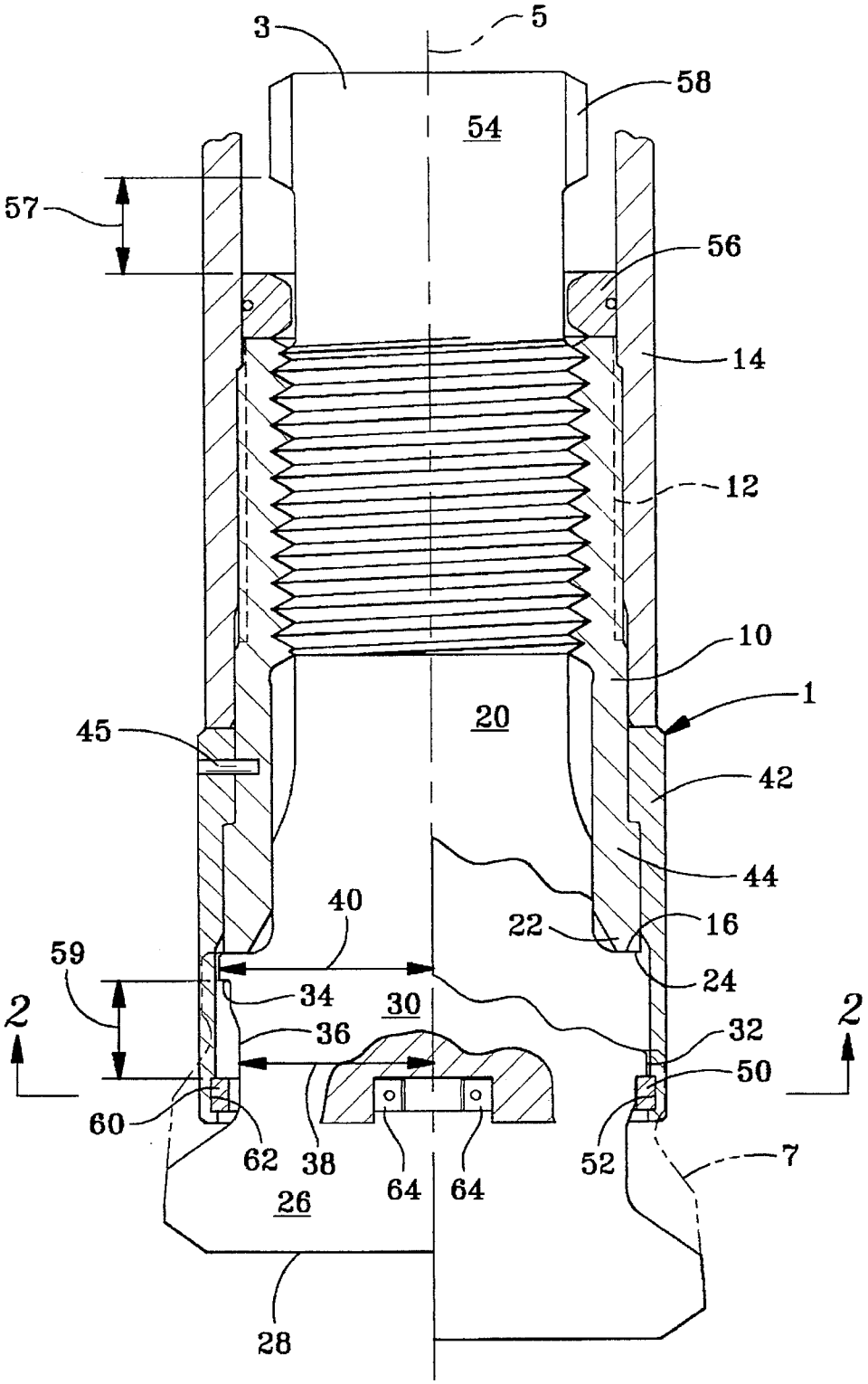
FIG. 1 is a schematic, longitudinal, cross-sectional view of the device according to the invention, with a prior art bit head working end shown in phantom, an unbroken bit depicted to the left of the centerline and a broken bit to the right of the centerline.

Now referring to the drawings, FIG. 1 is a schematic, longitudinal, cross-sectional view of the assembly 1 of the invention, with a bit 3 depicted unbroken to the left of the centerline 5 and depicted broken to the right of the centerline 5. A prior art bit head working end 7 is shown in phantom, for illustrative comparison.

The assembly of the invention includes a cylindrical chuck 10 adapted for connection by threads 12 to a drill string casing 14, as is conventional. Chuck 10 terminates in a radially extending lower end face surface 16. Drill bit 3 includes an axially extending shank 20 in driving engagement with chuck 10, as is conventional. Bit 3 terminates in a radially extending driving shoulder 22 having an upper surface 24 facing end face surface 16 of chuck 10. Bit 3 further includes a bit head 26 having a working face 28. Upper bit head portion 30 adjacent to driving shoulder 22 forms a radially extending bit retaining shoulder 32. Retaining shoulder 32 has a lower surface 34 facing bit working face 28. Annular undercut head portion 36 adjacent to retaining shoulder 32 extends axially along bit head 26. Undercut portion has a radial diameter 38 that is smaller than radial diameter 40 of retaining shoulder 32.

Wear collar 42, of hollow cylindrical form, is concentrically positioned about lower chuck portion 44, bit retaining shoulder 32 and annular undercut portion 36. Wear collar 42 can be, but need not be, rotatable with respect to chuck 10. If non-rotatable, wear collar 42 and chuck 10 can be a single piece, or if two pieces, they can be fixed together with a pin 45.

Flexible retaining member 50 is removably connected to an inner surface 52 of wear collar 42. Retaining member 50 is positioned axially between retaining shoulder 32 and bit working face 28. Retaining member 50 extends radially between wear collar 42 and bit head 26 a sufficient distance to stop retaining shoulder 32 should shank 20 break and a portion of bit head 26 drop axially downwardly. Thus, it can be understood that bit 3 is movable axially between chuck 10 and retaining member 50, but retained in chuck 10 by retaining shoulder 32 and retaining member 50. At upper end 54 of shank 20 bit 3 is retained in chuck 10 by split ring 56 and shank shoulder 58, as is well known. Axial distance 57 between shoulder 58 and split ring 56 is less than axial distance 59 between retaining shoulder 32 and retaining member 50, in order to assure that retaining member 50 is not contacted by shoulder 32 during normal operations.

Figure 2:
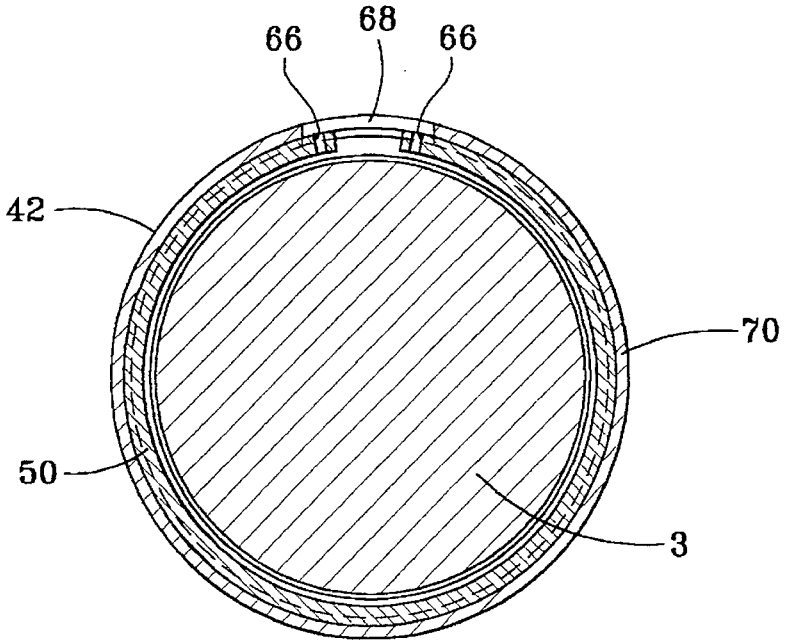
FIG. 2 is a view along 2—2 of FIG. 1.

Retaining member can be any flexible material. However, I prefer a flexibly expandable and contractible split ring 60, of material similar to split ring 56, commonly used in down-the hole drill applications. Split ring 60 is removably positioned in groove 62 of wear collar 42. Split ring 60 terminates in spaced apart end portions 64 that contain apertures 66 for gripping by an adjustment tool (not shown). Access to apertures 66 is through wear collar aperture 68 extending through the wall 70 of collar 42 (FIG. 2).

The device is assembled by first, dropping or forcing the retaining ring 60 over the retaining shoulder 32 and onto the smallest diameter of the bit head (annular undercut 36). The wear collar 42 is slipped or pressed over the chuck 10 as shown in FIG. 1. The chuck 10 and wear collar 42 assembly are then assembled over the shank 20 of the bit 3 as in present designs. Snap ring pliers with 90° bent tips are inserted into apertures 66 provided for this purpose via aperture 68. The snap ring 60 is compressed (reduced in diameter) by the pliers until the wear collar 42 can be assembled over the snap ring 60. The snap ring 60 is guided into the groove 62 in the wear collar 42 provided for that purpose. The snap ring 60 is allowed to expand into its groove 62 and the pliers removed. The balance of assembly of the downhole drill is then completed as required. Rotation of the drill string in either direction has no effect on the function of the device.

Figure 4:
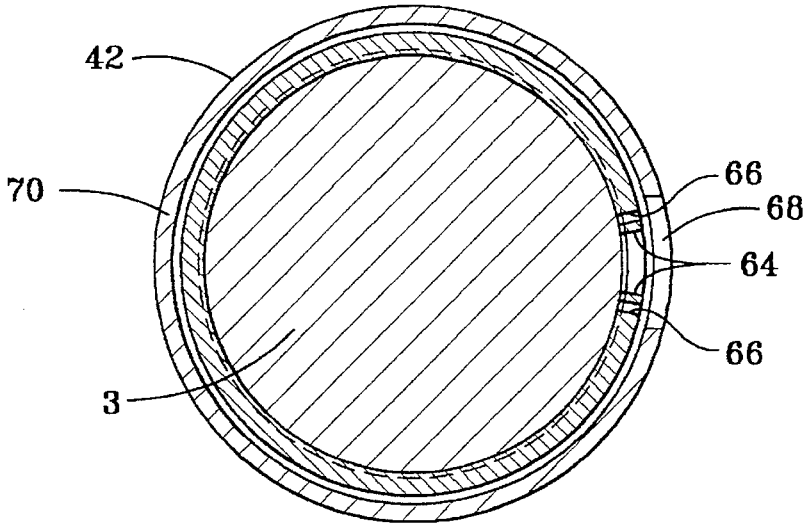
FIG. 4 is a view along 4—4 of FIG. 3.
Figure 3:
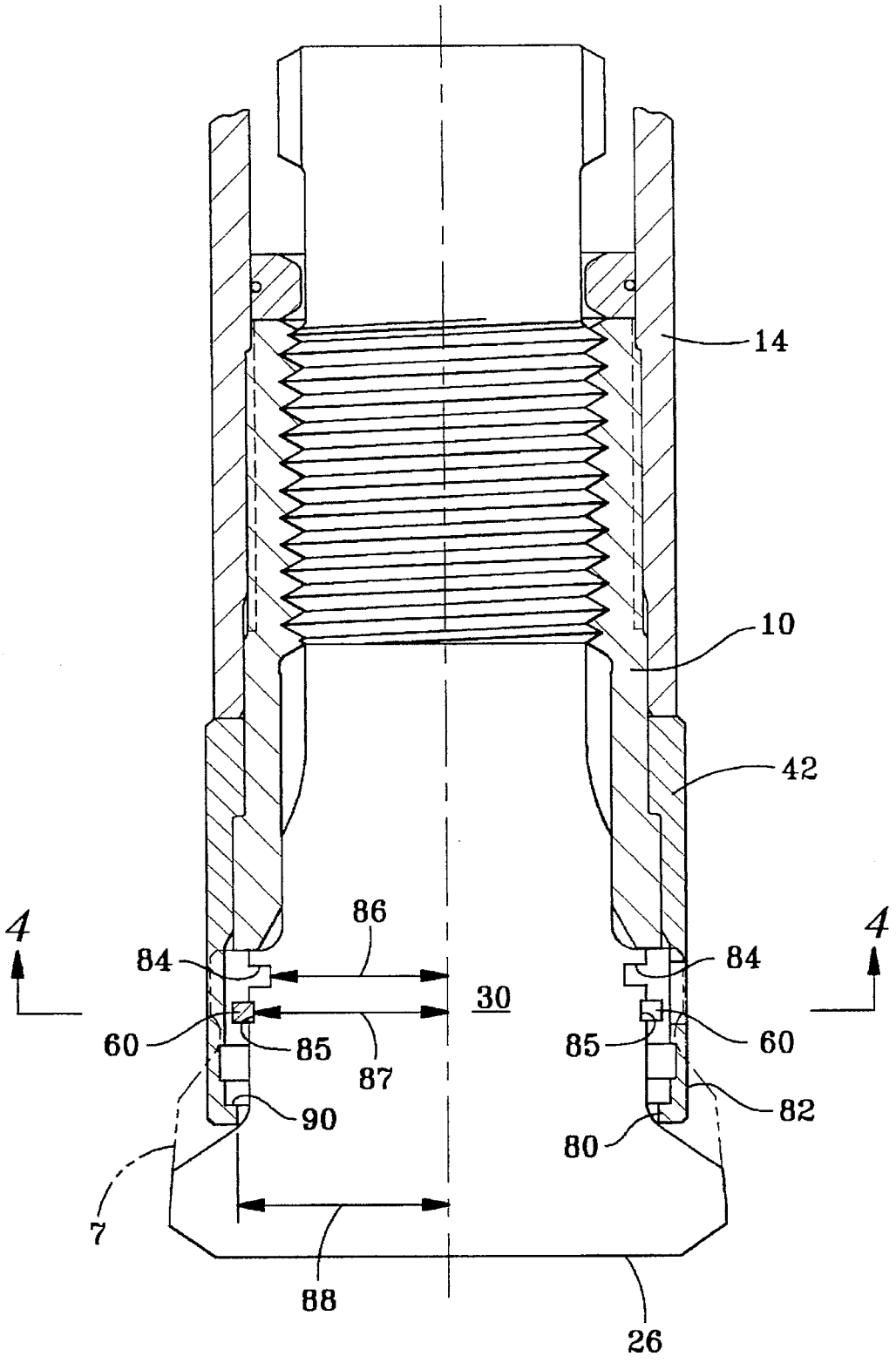
FIG. 3 is a schematic, longitudinal, cross-sectional view of an alternate embodiment of the invention, with a prior art bit head working end shown in phantom.

FIGS. 3 and 4 show an alternate embodiment of the assembly of the invention. Similar elements carry designations already assigned. Chuck 10 is unchanged. However, a radially extending bit retaining shoulder 80 is now formed in lower end 82 of collar 42. A first annular split ring groove 84 is provided in an upper portion 30 of bit head 26. A second annular split ring groove 85 is provided in an upper portion 30 of bit head 26 axially below first groove 84. First groove 84 has a radial diameter 86 that is smaller than a radial bore diameter 88 of wear collar 42 and radial diameter 87 of groove 85. Bit retaining shoulder 80 has an upper surface 90 facing groove 85. Split ring 60 is removably positioned in groove 85, as described hereinafter. Split ring 60 terminates in spaced apart end portions 64 that contain apertures 66 for gripping by an adjustment tool. Access to apertures 66 is through wear collar aperture 68 extending through the wall 70 of collar 42 (FIG. 4).

The device is assembled by first, expanding split ring 60 onto upper end 30 and allowing split ring 60 to snap into first groove 84. The wear sleeve is shipped or pressed over the chuck 10 and split ring 60. The chuck and sleeve assembly are then assembled over the shank of the bit as in present designs. A snap ring pliers with 90° bent tips is inserted into the lower side of the snap ring 60 into holes provided for this purpose. The snap ring is expanded by the pliers until it can be positioned into second groove 85. Diameter 87 of groove 85 assures that snap ring 60 extends radially between wear sleeve 42 and bit 3 a sufficient distance to prevent shoulder 80 from passing thereover, should shank 20 break and bit head 26 drop axially downwardly. The balance of assembly of the downhole drill is then completed as required. Rotation of the drill string in either direction has no effect on the function of the device.

Having described the invention, what is claimed is:

1. A bit retention device for a bit and chuck assembly of a down-the-hole, percussive drill, for retaining a head section of a bit should the head section separate from a shank of the bit comprising:

(a) a cylindrical chuck adapted for threadable connection to a drill casing, said chuck terminating in a radially extending lower end face surface;

(b) bit retaining shoulder means in said assembly for forming a radially extending bit retaining shoulder;

(c) a drill bit comprising:

(i) an axially extending shank in driving engagement with said chuck, said shank terminating in a radially extending driving shoulder, said driving shoulder having an upper surface facing said end face surface of said chuck;

(ii) a bit head having a working bit face; and (iii) an upper bit head portion adjacent to said retaining shoulder, said upper bit head portion extending axially along said bit head, said upper bit head portion having a radial diameter that is smaller than a radial diameter of said retaining shoulder;

(d) a wear collar of hollow cylindrical form concentric about a lower portion of said chuck and said upper bit head portion;

(e) a flexible retaining member removably connected to said assembly, said retaining member positioned within said wear collar, said retaining member positioned axially between said chuck end face surface and said bit working face, said retaining member extending radially between said wear collar and said upper bit head portion a sufficient distance to contact said retaining shoulder should said bit drop axially downwardly, whereby said drill bit is movable axially within said chuck, but retained within said chuck by said retaining shoulder and said retaining member; and (f) aperture means in said wear collar for permitting access to said retaining member by an adjustment tool.

2. A bit retention device for a bit and chuck assembly of a down-the-hole, percussive drill, for retaining a head section of a bit should the head section separate from a shank of the bit comprising:

(a) a cylindrical chuck adapted for threadable connection to a drill casing, said chuck terminating in a radially extending lower end face surface;

(b) a drill bit comprising:

(i) an axially extending shank in driving engagement with said chuck, said shank terminating in a radially extending driving shoulder, said driving shoulder having an upper surface facing said end face surface of said chuck;

(ii) a bit head having a working bit face;

(iii) an upper bit head portion adjacent to said driving shoulder forming a radially extending bit retaining shoulder, said retaining shoulder having a lower surface facing said bit working face; and (iv) an annular undercut head portion adjacent to said retaining shoulder, said annular undercut portion extending axially along said bit head, said undercut portion having a radial diameter that is smaller than a radial diameter of said retaining shoulder;

(c) a wear collar of hollow cylindrical form concentric about a lower portion of said chuck, said bit retaining shoulder and said annular undercut portion;

and (d) a flexible retaining member removably connected to an inner surface of said wear collar, said retaining member positioned axially between said retaining shoulder and said bit working face, said retaining member extending radially between said wear collar and said bit head a sufficient distance to stop said retaining shoulder should said bit drop axially downwardly, whereby said drill bit is movable axially between said chuck end face and said retaining member, but retained within said chuck by said retaining shoulder and said retaining member.

3. The bit retention device of claim 2 wherein said retaining member is a flexibly expandable and contractible split ring removably positioned in an annular groove in said wear collar inner surface.

4. The bit retention device of claim 3 further comprising:

aperture means in said wear collar for permitting access to said retaining member by an adjustment tool.

5. A bit retention device for a bit and chuck assembly of a down-the-hole, percussive drill, for retaining a head section of a bit should the head section separate from a shank of the bit comprising:

(a) a cylindrical chuck adapted for threadable connection to a drill casing, said chuck terminating in a radially extending lower end face surface;

(b) a drill bit comprising:

(i) an axially extending shank in driving engagement with said chuck, said shank terminating in a radially extending driving shoulder, said driving shoulder having an upper surface facing said end face surface of said chuck;

(ii) a bit head having a working bit face and an upper bit head portion;

(iii) a first annular groove in said upper bit head portion adjacent to said driving shoulder having an outer surface with an annular groove therein; and (iv) a second annular groove in said upper bit head portion axially below said first annular groove, said first annular groove having a radial diameter that is smaller than a radial diameter of second annular groove;

(c) a wear collar of hollow cylindrical form concentric about a lower portion of said chuck, said first and second annular bit grooves, said wear collar having a radially extending bit retaining shoulder, said retaining shoulder having an upper surface facing said annular bit groove;

and (d) a flexible retaining member removably positioned in said second bit annular groove, said retaining member positioned axially between said drive shoulder and said bit working face, said retaining member extending radially between said wear collar and said bit head a sufficient distance to stop said bit should said bit drop axially downwardly, whereby said drill bit is movable axially between said chuck end face and said retaining member, but retained within said chuck by said retaining shoulder and said retaining member.

6. The bit retention device of claim 5 wherein said retaining member is a flexibly expandable and contractible split ring removably positioned in said annular groove.

* * * * *